US007568687B2

(12) United States Patent
Sasamoto

(10) Patent No.: US 7,568,687 B2
(45) Date of Patent: Aug. 4, 2009

(54) BINDING APPARATUS AND IMAGE FORMATION SYSTEM USING THE SAME

(75) Inventor: Shinya Sasamoto, Hokuto (JP)

(73) Assignee: Nisca Corporation, Yamanashi-ken (JP)

( * ) Notice: Subject to any disclaimer, the term of this patent is extended or adjusted under 35 U.S.C. 154(b) by 209 days.

(21) Appl. No.: 11/684,590

(22) Filed: Mar. 9, 2007

(65) Prior Publication Data

US 2007/0212199 A1 Sep. 13, 2007

(30) Foreign Application Priority Data

Mar. 9, 2006 (JP) ..... 2006-064885

(51) Int. Cl.
*B65H 33/04* (2006.01)
*B65H 39/00* (2006.01)
*B42C 13/00* (2006.01)

(52) U.S. Cl. ..... 270/58.07; 270/58.08; 270/58.09; 412/11; 412/12; 412/13; 412/19; 412/20

(58) Field of Classification Search ..... 270/58.07, 270/58.08, 58.09; 412/11–13, 19–20, 33, 412/37

See application file for complete search history.

(56) References Cited

U.S. PATENT DOCUMENTS 4,556,353 A * 12/1985 Ehlermann ..... 412/5
6,213,456 B1 * 4/2001 Hirano et al. ..... 270/58.08

* cited by examiner

*Primary Examiner*—Gene Crawford
*Assistant Examiner*—Yolanda Cumbess
(74) *Attorney, Agent, or Firm*—Judge Patent Associates

(57) ABSTRACT

Bookbinding apparatus facilitating, in the event it is halted during operation, the removal of any sheave left remaining inside, to eliminate the risk of sheets scattering. A sheet bundler/stacker bundles printed sheets into sheaves. Along a binding process path are provided a sheave transporter for transporting the sheaves and, at the downstream end of the bundler/stacker, an adhesive applicator in an adhesive-application position and a front-cover binder in a front-cover binding position. A sheave exiting-conveyor conveys sheaves from the front-cover binder into a storage stacker. A sheet-position recognizer detects/monitors the position of a sheave in the binding process path. If the bookbinding operations are interrupted, the position of any sheave left in the binding process path is determined by the sheet-position recognizer, and when the apparatus is restarted the order of the binding processes is altered depending on the position in which the sheave is left behind.

22 Claims, 10 Drawing Sheets

BINDING APPARATUS AND IMAGE FORMATION SYSTEM USING THE SAME

BACKGROUND OF THE INVENTION

1. Technical Field

The present invention relates to a binding apparatus that bundles sequentially-supplied printed sheets into a plurality of sheaves of to-be-bundled sheets to bind the sheaves with glue or other adhesive together with a front cover, and an image formation system that automatically subjects printed sheets transferred from an image formation apparatus (e.g., printer, printing machine, copy machine) to a binding-finishing process.

2. Description of the Related Art

Generally, this type of apparatus has been widely used as a terminal apparatus of an image formation system (e.g., printer, printing machine) that functions as an automatic binding system in which sheets having thereon images are superposed in an order of pages to divide the sheets to a plurality of a set of to-be-bundled sheets to subsequently glue the end faces to bundle the end faces with a front cover sheet or that functions as a binding apparatus that divides printed sheets supplied from a paper supply opening to a set of to-be-bundled sheets to bind the to-be-bundled sheets with a front cover sheet. In particular, a system for providing an on-demand printing such as electronic publishing has been known in which a printing processing and a binding process are simultaneously performed by printing a predetermined document for example while subjecting the document to an automatic binding with a top cover to subsequently cut sheet ends to complete a booklet.

Japanese Unexamined Pat. App. Pub. No. 2004-209869 discloses an example of an apparatus in respect of a system as described above. This apparatus has a structure in which sheets outputted from an image formation system are subjected to an automatic binding finishing. According to Pat. App. Pub. No. 2004-209869, sheets are outputted from the image formation apparatus to a catch tray and the sheets in the catch tray are guided to a sheet carry-in route. Then, the guided sheets are accumulated in a placement tray at the downstream of this route. Thereafter, a sheet bundle accumulated in a horizontal direction in the placement tray is turned 90 degrees to be placed in a vertical direction. Then, the vertically-arranged sheet bundle is guided to a gluing apparatus in which the sheet bundle is subjected to a coating processing. This glued sheet bundle is folded together with a front cover sheet supplied from an inserter apparatus and the resultant bundle is bound. Thereafter, a not glued end face of this glued sheet bundle is cut and trimmed.

When the above binding process in the conventional system disclosed in JP Pat. App. Pub. No. 2004-209869 as described above is stopped due to a power shutdown for example, the above placement tray includes sheets in a disordered manner, sheets not yet adhered or bundled in a range from a sheet accumulation position to an adhesive-application position are retained by a transportation means (e.g., grip means), and sheets adhered in a bundle are left at the downstream of a coating position.

When a power source of the apparatus is accidentally stopped when printed sheets in a binding route are sequentially subjected to processes of accumulation, gluing, front-cover bind-on, sheet cutting, and ejected paper storage as described above, power shutdown during an error (e.g., paper jam) generally requires an operator to perform a recovery operation to manually take sheets left in the apparatus to subsequently recover the apparatus to an initial status to start the apparatus again. In order to make this recovery operation simpler, some copy machines have adopted a method to remove sheets causing a defect (e.g., jammed papers) to automatically eject sheets left in the apparatus when the apparatus is restarted.

However, when the above-described binding apparatus includes sheet bundles left in a disordered manner and the sheet bundles are removed by an operator or when the sheet bundles are automatically ejected at the restart of the apparatus, a risk is caused where sheets may be scattered in the apparatus. In the case where the apparatus is structured so that a binding process path is arranged in a vertical direction to grip and transport sheet bundles in a longitudinal direction in particular, sheets may be dropped and scattered in the apparatus when an operator cancels the grip of the sheets in order to remove the sheets left in the apparatus. In the case of an apparatus having another structure in which this sheet bundle is transported to a storage stacker when the apparatus is restarted on the other hand, a problem is caused in which sheet bundles may be scattered in the stacker.

In view of the above, it is a main objective of the present invention to provide a binding apparatus in which a sheet bundle left therein can be removed easily when the apparatus is stopped in the middle of a binding process to prevent a risk of scattered sheets.

It is another objective of the present invention to provide a binding apparatus and an image formation system having a structure including a binding process path in a vertical direction by which a sheet bundle left in the route when the apparatus is interrupted can be removed depending on the status of the sheet bundle.

BRIEF SUMMARY OF THE INVENTION

In order to solve the above problem, the present invention uses the following structure. It is noted that the term "apparatus discontinuation" in the present invention means a status in which a defective operation of the apparatus (e.g., paper jam) causes the apparatus to stop or a power source of the apparatus is shut down and stops due to a power failure or other reasons to discontinue a binding process operation in the middle of the operation. The term "casing-in binding" in the present invention means a binding process for binding the top and back of a sheet bundle having a back section coated with adhesive so as to case the top and back by a front cover sheet. The term "back glue binding" means a binding process for gluing and binding a back section of a sheet bundle.

This apparatus includes a sheet bundling/stacking means for bundling printed sheets transported from an image formation apparatus or printed sheets supplied to a supply opening to bundles; and a binding process path that has, at the downstream of this sheet bundling/stacking means, an adhesive-application position and a front-cover binding position. This route includes: a sheave transport means for transporting sheet sheaves; an adhesive application means at the adhesive-application position; and a front-cover binding means at the front-cover binding position. This apparatus also includes: a sheave exiting-conveyance means for carrying out the sheet bundle from the above front-cover binding means to a storage stacker; and a sheet-position recognition means for detecting or monitoring a position of the sheet bundle in the above binding process path. Then, the sheet bundle from the above sheet bundling/stacking means is sequentially subjected, by a control means, to binding processes of adhesive application, front-cover bind-on, and carrying-out of the sheet bundle in this order. The control means has the following structure.

This control means is structured so that, in the case of a power source shutdown or another discontinuation of the apparatus, a position of a sheet bundle left in the above binding process path is determined by the above sheet-position recognition means so that the above binding processes are arranged, when the apparatus is restarted, in a different order depending on the position of the sheet bundle left in the route. This allows, when the apparatus is restarted after apparatus discontinuation, the sheet bundle to be subjected, depending on the position of the sheet bundle left in the binding process path, to a binding process by adhesive to subsequently carry out the sheet bundle to a stacker. Specifically, a sheet bundle left in the binding process path positioned at the adhesive-application position or at the upstream thereof can be coated with adhesive by the adhesive application means and is subsequently carried out to the storage stacker without being bound with a front cover sheet by the front-cover binding means. This allows, when apparatus discontinuation is caused, a sheet bundle to be automatically carried out to the storage stacker, thus preventing the sheets from being scattered in the apparatus. Next, the image formation system of the present invention is composed of: an image formation apparatus for sequentially subjecting printed sheets to an image formation processing; and a binding apparatus for bundling the printed sheets from this image formation apparatus to sets of sheets to bind the sets. This binding apparatus has the structure as described above.

According to the present invention, a sheet bundle left in the apparatus when the apparatus is restarted after apparatus discontinuation is determined by the sheet-position recognition means so that, when the remaining sheet bundle is not coated with adhesive, the sheet bundle is coated with adhesive and is carried out to the storage stacker without being bound with a top sheet. This eliminates a need for an operator to remove sheet bundles scattered in a disordered manner and also eliminates a risk where sheet bundles carried out to the stacker are scattered in a disordered manner. The above configuration that can automatically carry out a sheet bundle while being bound is advantageous in that an image formation system can be efficiently operated to automatically perform various processes from an image formation to a book binding for example.

DETAILED DESCRIPTION OF THE INVENTION

Figure 1:
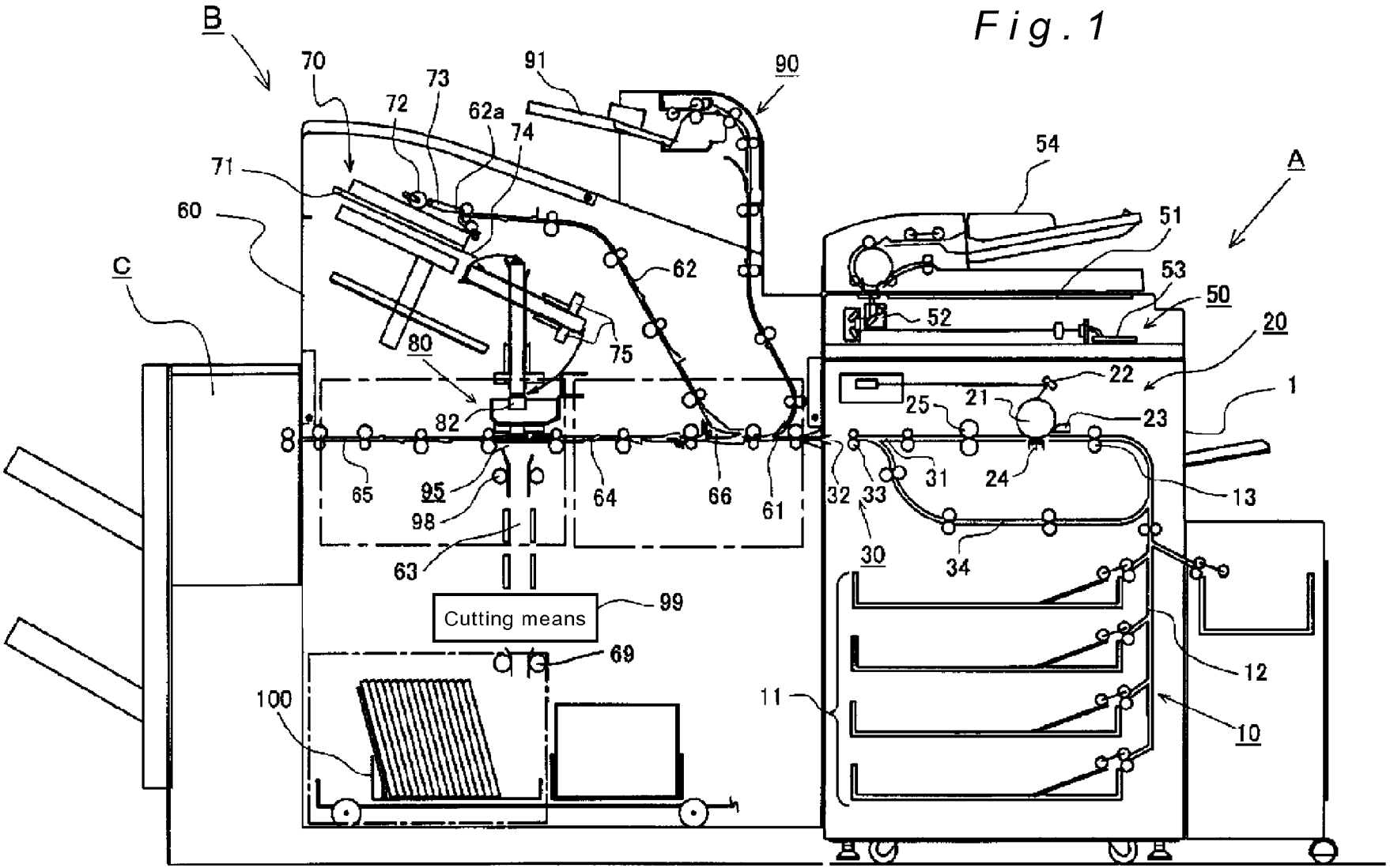
FIG. 1 illustrates the entire structure of an image formation system of the present invention.
Figure 2:
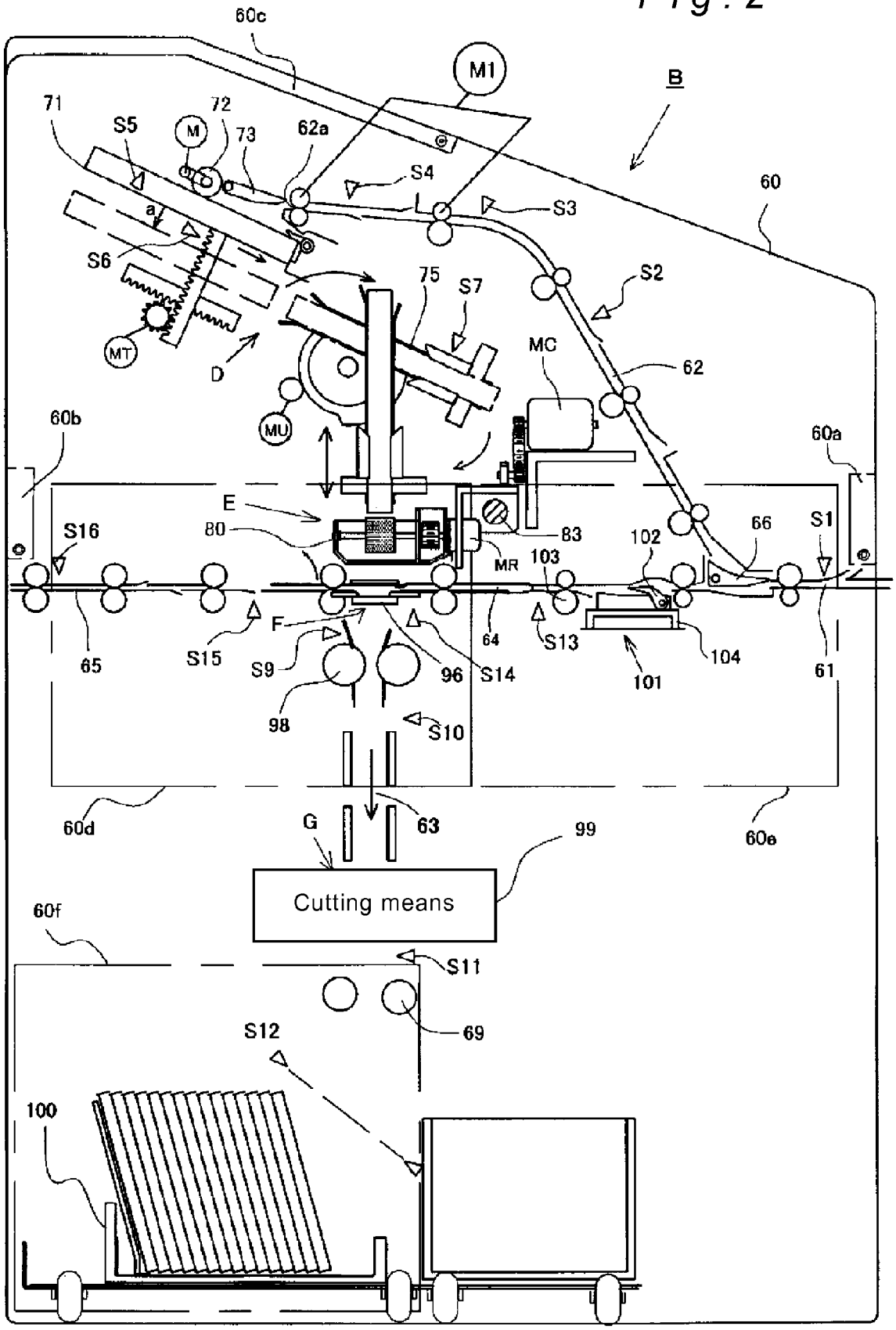
FIG. 2 illustrates the details of a binding apparatus in the system of FIG. 1.

Hereinafter, the present invention will be described in detail with reference to the shown preferred embodiments. FIG. 1 illustrates the entire structure of an image formation system using a binding apparatus according to the present invention. FIG. 2 illustrates the binding apparatus in detail.

The image formation system shown in FIG. 1 is composed of: an image formation apparatus A for sequentially subjecting sheets to a printing operation; a binding apparatus B provided at the downstream side of this image formation apparatus A; and a finisher apparatus C provided at the downstream of this binding apparatus B. This image formation system is structured so that a sheet on which an image is formed by the image formation apparatus A is subjected to a binding process by the binding apparatus B or passes this binding apparatus B to be subjected to a subsequent processing by the finisher apparatus C. With regards to the image formation apparatus A, various structures (e.g., copy machine, printer, printing machine) have been known. However, the shown image formation apparatus A represents an electrostatic printing apparatus. This image formation apparatus A is structured so that a casing 1 includes therein a paper feeding section 10, a printing section 20, a paper ejection section 30, and a control section 40 (see FIG. 8). The paper feeding section 10 includes a plurality of cassettes 11 depending on sheet sizes that supply a sheet having a size specified by a control section 40 to a paper-feeding route 12. This paper-feeding route 12 includes a resist roller 13 that sets a tip end of a sheet at a predetermined position to subsequently supply the sheet, with a predetermined timing, to the printing section 20 at the downstream.

The printing section 20 includes an electrostatic drum 21 around which a printing head 22, a development unit 23, a transfer charger 24 or the like are provided. The printing head 22 is composed of a laser light-emitting unit for example and forms an electrostatic latent image on the electrostatic drum 21 and this latent image is attached with toner ink by the development unit 23, thereby printing the sheet by the transfer charger 24 (hereinafter referred to as a printed sheet Sp). This printed sheet Sp is fixed by a fixing unit 25 and is carried out to a paper ejection route 31. The paper ejection section 30 includes a catch tray 32 and a paper ejection roller 33 provided in the casing 1. It is noted that the reference numeral 34 represents a circulation route through which the top and back of the printed sheet Sp from the paper ejection route 31 are inverted by a switch back route to subsequently send the printed sheet Sp again to the resist roller 13, thereby forming an image on the back face of the printed sheet Sp. The printed sheet Sp one surface or both surfaces of which is/are formed with an image or images in this manner is carried from the catch tray 32 to the paper ejection roller 33.

It is noted that the reference numeral 50 denotes a scanner unit that optically reads a document image printed by the above printing head 22. The scanner unit 50 has a generally-known structure composed of: a platen 51 in which a document sheet is placed and set; a carriage 52 for scanning the document image along this platen 51; and an optical reading means (e.g., CCD device) 53 for subjecting the optical image from this carriage 52 to a photoelectric conversion. The shown scanner unit 50 includes an automatic document feeding apparatus 54 for automatically supplying a document sheet to the platen that is provided on the platen 51.

Next, the binding apparatus B attached to the above-described image formation apparatus A will be described. This binding apparatus B is composed of: a sheet bundling/stacking means 70 for accumulating the printed sheets Sp in the casing 60 so that the printed sheets Sp are set as bundles; an adhesive application means 80 for coating the sheet bundle from this sheet bundling/stacking means 70 with adhesive; and a front-cover binding means 95 for binding the adhesive-coated sheet bundle with a front cover sheet. The above sheet bundling/stacking means 70 includes, as described later, a to-be-bound sheets transportation route 62 at the upstream side thereof and a binding process path 63 at the downstream side thereof, respectively. The sheet bundling/stacking means 70 includes a placement tray 71 provided in a substantially horizontal direction. In the placement tray 71, the printed sheet Sp sent from the catch tray 62*a* of the above to-be-bound sheets transportation route 62 is loaded and stored.

This placement tray 71 has, at the upper part thereof, a forward reverse roller 72 and a guide piece 73. The printed sheet Sp from the catch tray 62*a* is guided by the guide piece 73 onto the placement tray 71 and is stored by the forward reverse roller 72. This forward reverse roller 72 forwardly rotates to store the printed sheet Sp in the placement tray 71 and rotates in reverse to abut and regulate a sheet with a rear end regulation member 74 provided at a tray rear end. The placement tray 71 includes an alignment means (not shown) that aligns one side edge of the printed sheet Sp stored in the tray at a reference position. By the structure as described above, the printed sheets Sp from the to-be-bound sheets transportation route 62 are sequentially accumulated in the placement tray 71 and are divided to bundle sets.

The structures of the to-be-bound sheets transportation route 62 and the binding process path 63 will be described. The binding apparatus B is structured so that the casing 60 includes: a sheet carry-in route 61; the to-be-bound sheets transportation route 62; the binding process path 63; a front cover sheet transportation route 64; and a paper ejection route 65 as shown in the drawing. The sheet carry-in route 61 is connected to the catch tray 32 of the above-described image formation apparatus A to receive the printed sheet Sp from the image formation apparatus A. In this case, the image formation apparatus A sends, to the sheet carry-in route 61, a printed sheet (to-be-bound sheets) Sp on which contents information is printed and a printed sheet (hereinafter referred to as front cover sheet Sh) used as a top cover on which a title or the like is printed. The sheet carry-in route 61 branches to the to-be-bound sheets transportation route 62 and the front cover sheet transportation route 64 and allocates the respective printed sheets via a route switching means (guide flapper member) 66 to the respective routes.

On the other hand, the above sheet carry-in route 61 is connected with an inserter unit 90 (see FIG. 1) that separates a front cover sheet not subjected to a printing processing by the image formation apparatus A from a paper-feeding tray 91 to supply the separated front cover sheet to the sheet carry-in route 61. As described above, the to-be-bound sheets transportation route 62 branching from the sheet carry-in route 61 is connected with the above-described sheet bundling/stacking means 70. This sheet bundling/stacking means 70 has, at the downstream side thereof, the binding process path 63 through which accumulated to-be-bound sheets as bundles (hereinafter simply referred to as sheet bundles) Sp are subjected to a binding process while sequentially transferred. The shown binding process path 63 is provided in the substantially vertical direction and has, at the downstream side thereof, a sheet bundle posture turning position D, an adhesive-application position E, a front-cover binding position F, and a cutting processing position G that are sequentially arranged in this order. The above front cover sheet transportation route 64 intersects with the binding process path 63 at the front-cover binding position F to supply the front cover sheet Sh to this front-cover binding position F.

Next, the structure of the above binding process path 63 will be described. The shown apparatus is characterized in that the sheet bundling/stacking means 70 is placed in a substantially horizontal direction and the binding process path 63 is placed in a substantially vertical direction to provide the apparatus with a compact size. Due to this structure, the sheet bundle Sp accumulated in the sheet bundling/stacking means 70 must be turned to have a vertical posture instead of a horizontal posture. Thus, the binding process path 63 includes the sheet bundle posture turning position D. At this sheet bundle posture turning position D, the placement tray 71 is moved from a sheet accumulation position (solid line in FIG. 2) to a delivery position (chain line in FIG. 2) so that the sheet bundle Sp can be delivered to the sheave transport means 75 prepared at this delivery position.

Figure 3A:
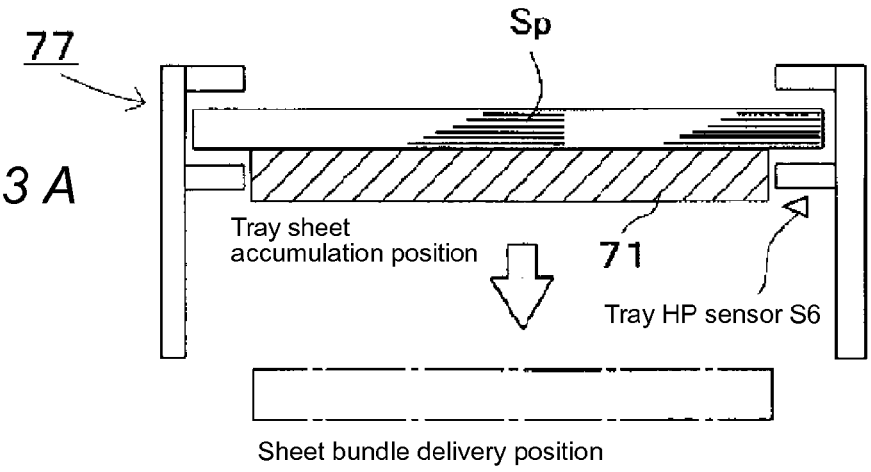
FIG. 3 illustrates the operation status of a tray gripper provided in a sheet loading tray in the apparatus of FIG. 2.
Figure 3B:
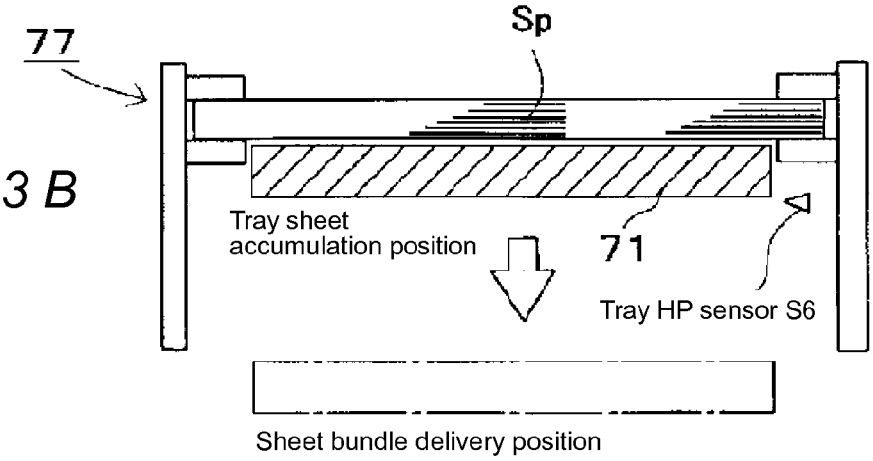
Figure 3C:
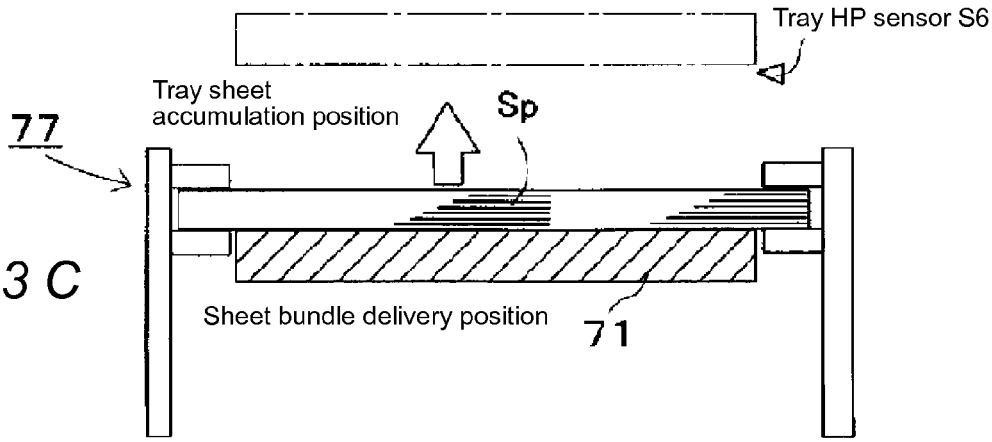

The placement tray 71 is supported by an apparatus frame in an up-and-down direction (arrow "a") in FIG. 2 so as to be movable in an up-and-down direction. For example, the placement tray 71 is supported by a guide rail provided in the apparatus frame so that the placement tray 71 is moved in an up-and-down direction by a tray-up-and-down motor MT via a rack and a pinion or a driving belt. In order to prevent the sheet bundle Sp in the placement tray 71 from being scattered, grip means (hereinafter referred to as tray grippers 77) are provided at sides of the placement tray 71 that hold and position the sheet bundle Sp when the placement tray 71 is moved in an up-and-down direction. Specifically, both left and right sides of the placement tray 71 have a pair of left and right gripper members as shown in FIG. 3 arranged so as to hold sheet corner sections (sheet end sections). The tray grippers 77 are driven by a tray gripper motor MTG (not shown) to hold a sheet end section of the sheet bundle Sp in the placement tray 71. The placement tray 71 is moved from the sheet accumulation position ((a) in the drawing) to (b) in which the sheet end section of the sheet bundle Sp is held and then the placement tray 71 is lowered to the status shown by (c) to the delivery position.

Figure 4:
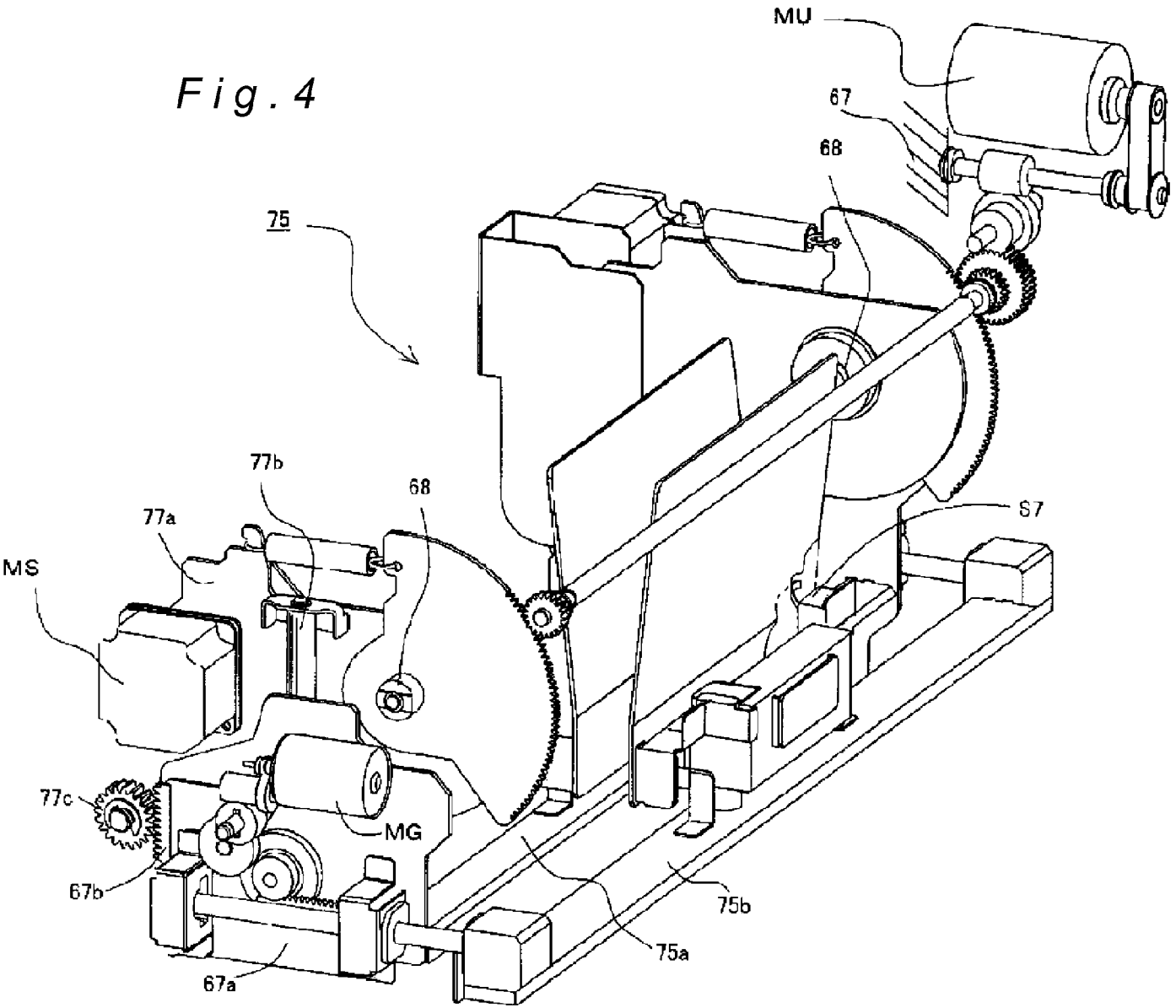
FIG. 4 illustrates the structure of a sheave transport means (grip transfer means) in the apparatus of FIG. 2.

Then, the sheet bundle Sp in the placement tray 71 moved to the shown by the chain line in FIG. 2 is delivered and transported by the sheave transport means 75. This sheave transport means 75 is composed of; a pair of grip members 75*a* and 75*b* for gripping the sheet bundle Sp as shown in FIG. 4; and a gripper unit including the grip motor MG for causing the grip members 75*a* and 75*b* to perform a grip operation. This gripper unit (sheave transport means) 75 is supported by the apparatus frame 67 so as to be rotatable around a rotation axis 68 and is rotated by a unit rotation motor MU provided at the apparatus frame side. This gripper unit 75 includes a fixed grip member 75*a* and a movable grip member 75*b*. The movable grip member 75*b* is driven by the grip motor MG so that the movable grip member 75*b* can go toward or away from the fixed grip member 75*a*.

The above movable and fixed grip members 75*a* and 75*b* are supported by the gripper frame 67*a* together with the grip motor MG. This gripper frame 67*a* is supported by the guide rail 77*b* to the unit frame 77*a* so as to be movable in the up-and-down direction of FIG. 4. The gripper frame 67*a* is driven in an up-and-down direction by a shift motor MS attached to the unit frame 77*a* and by a pinion 77*c* and a rack 67*b*. By the structure as described above, the gripper unit 75 driven by the grip motor MG uses the grip members 75*a* and 75*b* to hold the sheet bundle Sp in the placement tray 71 and the unit rotation motor MU turns the posture of the sheet bundle Sp from a horizontal posture to a vertical posture.

Then, the sheet bundle Sp having this vertical posture being held by the grip members 75*a* and 75*b* is transferred by the shift motor MS along the binding process path 63 to the downstream.

Figure 5:
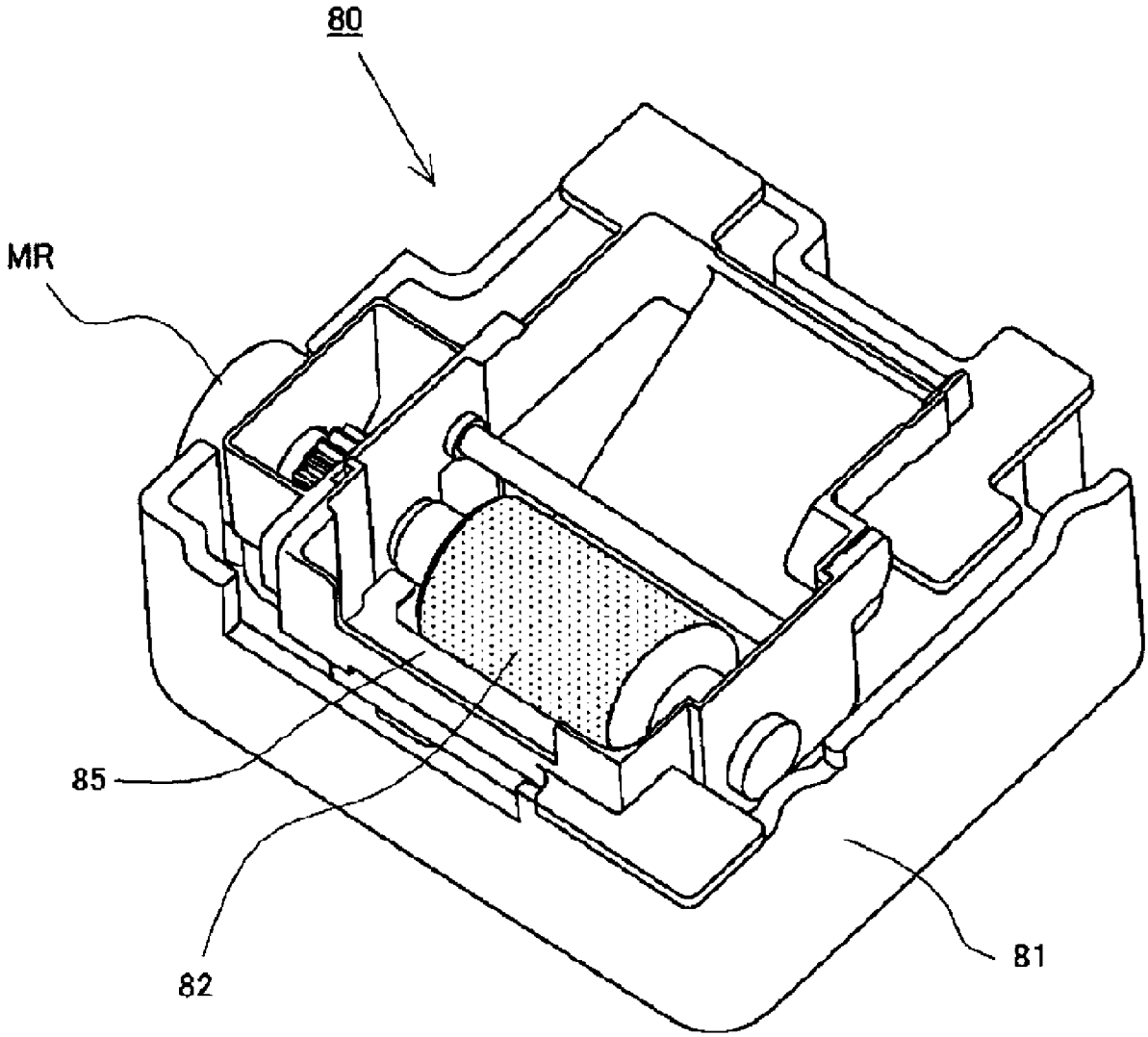
FIG. 5 is a perspective view illustrating an adhesive storage container in the apparatus of FIG. 2.

Next, the adhesive-application position E placed in the above binding process path 63 includes an adhesive application means 80. This adhesive application means 80 is composed of a glue container 81 storing therein thermofusion-type adhesive, a coating roller 82, and a roller rotation motor MR. This coating roller 82 and the roller rotation motor MR are provided in the glue container 81 (see FIG. 5). The glue container 81 is supported along the sheet bundle Sp set at the above coating position E. As shown in FIG. 2, the glue container 81 is supported by a guide rail (guide axis) 83 provided at the apparatus frame in a slidable manner, fixed to a driving belt connected to the carriage motor MC, and reciprocates by being forward/reverse driven by the carriage motor MC in the front-to-back directions of the FIG. 2 sheet, lengthwise along the sheet bundle Sp.

Figure 6A:
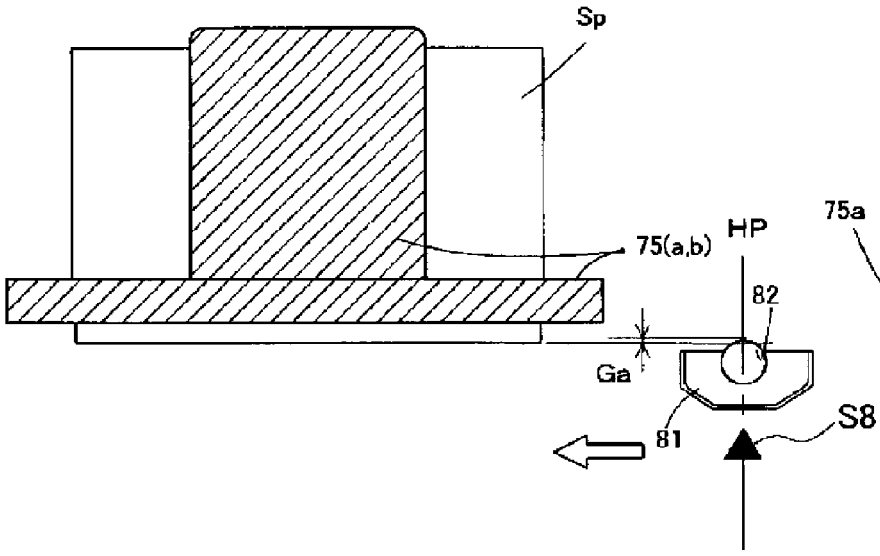
FIG. 6 illustrates the operation status showing a coating operation of the adhesive storage container of FIG. 5.

This carriage motor MC reciprocates from a home position HP of FIG. 6A along the longitudinal direction of sheet bundle Sp. The carriage motor MC is moved in a homeward path in FIG. 6B to a home position HP. When the carriage motor MC is in an outward path, the coating roller 82 is strongly abutted with an end face of the sheet bundle Sp (FIG. 6C) to separate sheet ends. When the carriage motor MC in the homeward path, a small space is formed between the roller surface and the end face of the sheet bundle (FIG. 6D) to coat thick adhesive on the surface of the roller. Thus, the glue container 81 includes a doctor blade 85 (see FIG. 5) for uniformly controlling the adhesive at the surface of the coating roller 82. With regards to the space between the surface of the roller and the end face of the sheet bundle, the rotation of the shift motor MS constituting the sheave transport means 75 is controlled to adjust the positions of the grip members 75*a* and 75*b* (upper and lower positions of FIG. 5). When the gap Ga is increased, an amount of adhesive coated on the sheet bundle Sp is also increased. Thus, the above gap Ga can be changed in a small or large amount to adjust the amount of the adhesive application on the sheet bundle Sp.

Next, the front-cover binding position F of the above binding process path 63 has the front-cover binding means 95. This front-cover binding position F is supplied with the front cover sheet Sh from the above-described front cover sheet transportation route 64. At this front-cover binding position F, the front cover sheet Sh and the sheet bundle Sp from the above adhesive-application position E are subjected to a casing-in binding as described later. At this front-cover binding position, there are provided a backup plate 96 for backing up the front cover sheet Sh; a press block 97 for subjecting a joined section (back section) of the sheet bundle Sp and the front cover sheet Sh to a press forming; and a bent roll 98. This backup plate 96, the press block 97, and the bent roll 98 constitute the front-cover binding means 95 that performs a casing-in binding process in a procedure shown in FIGS. 7A to 7D.

Figure 6C:
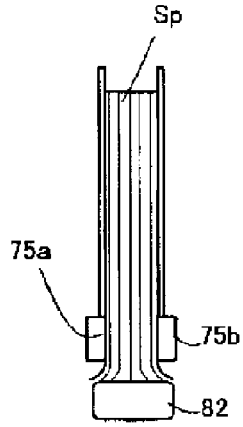
Figure 6B:
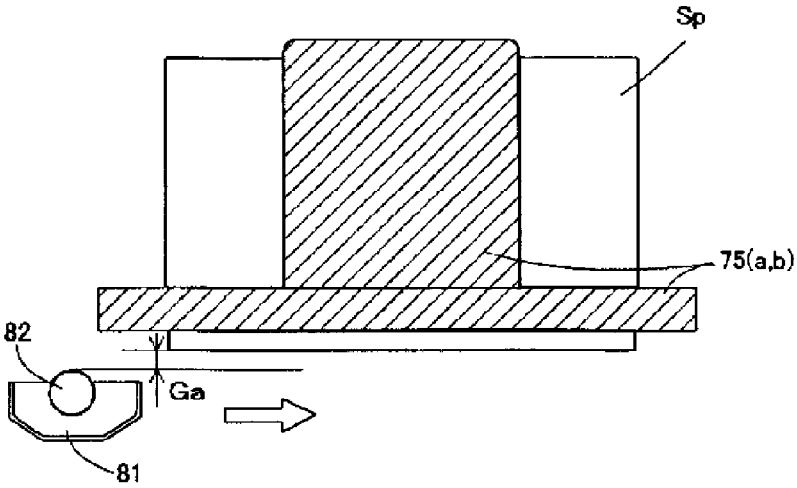
Figure 6D:
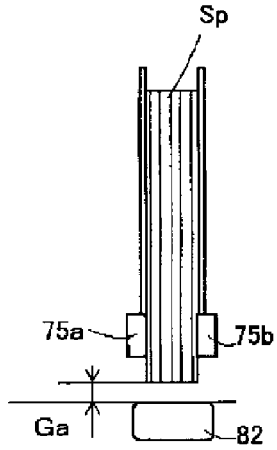
Figure 7A:
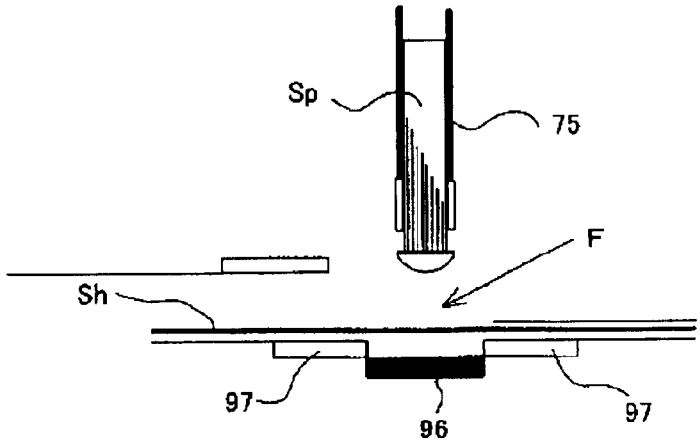
FIG. 7 illustrates the operation status of a sheet binding means in the apparatus of FIG. 2.
Figure 7B:
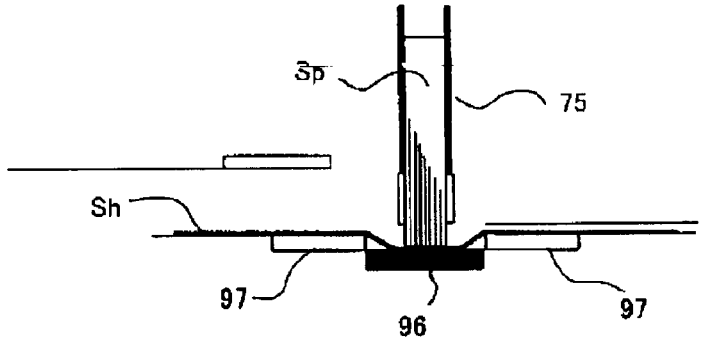
Figure 7C:
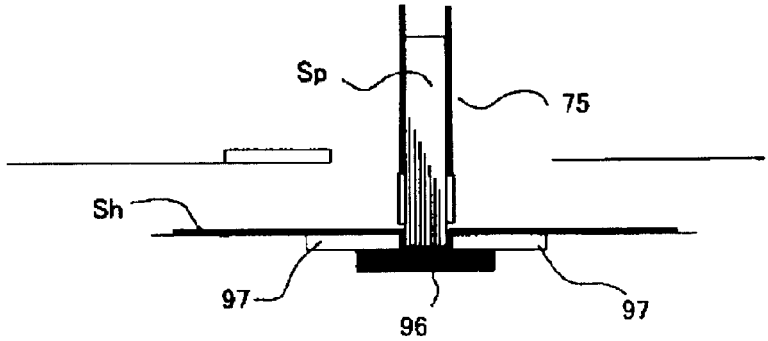
Figure 7D:
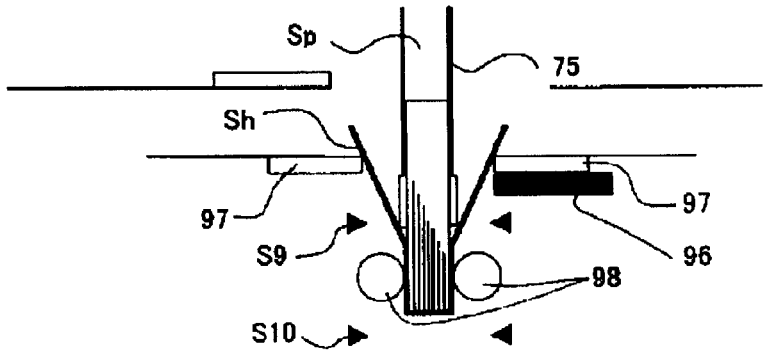

FIG. 7A shows a status just before the joint of the front cover sheet Sh with the sheet bundle Sp in which the sheet bundle Sp is moved by the sheave transport means 75 to the lower side of FIG. 7A. As shown in FIG. 7B, the sheet bundle Sp is then abutted with the center of the front cover sheet Sh while the front cover sheet Sh being supported by the backup plate 96. On the other hand, the above press block 97 is composed of a pair of left and right block members that can be moved between a withdrawal position at which the block members are withdrawn from the binding process path 63 and an operative position at which the block members are abutted to each other in the binding process path 63. When the block members are moved from the withdrawal position to the operative position as shown in FIG. 6C, the sheet bundle Sp and the back section of the front cover sheet Sh are subjected to a press formation. After this press formation, the backup plate 96 and the press block 97 are withdrawn from the binding process path 63. When the sheet bundle Sp in this status is moved by the sheave transport means 75 to the downstream side, this sheet bundle Sp is received by the bent roll 98 and the front cover sheet Sh wraps the to-be-bound sheets (condition in FIG. 7D). In this manner, the to-be-bound sheets (sheet bundle) Sp are subjected to a casing-in binding with the front cover sheet Sh.

Next, the cutting processing position G positioned at the downstream of the above bent roll 98 of the binding process path 63 includes a cutting means 99 (not shown). The cutting means 99 cuts the periphery of the sheet bundle Sp bound in a booklet-like manner other than the back section thereof in a predetermined amount. This cutting processing position G has, at the downstream side thereof, sheave exiting-conveyance means 69 as a pair of rollers (hereinafter referred to as bundle carrying-out means 69). This bundle carrying-out means 69 has, at the downstream thereof, a storage stacker 100. This storage stacker 100 is a box-like tray as shown in the drawing that stores the sheet bundle Sp from the bundle carrying-out means 69 in a headstand status.

Next, the structure of the above front cover sheet transportation route 64 will be described. The front cover sheet transportation route 64 branching from the sheet carry-in route 61 as described above is a composed by a route in a substantially horizontal direction crossing the apparatus and supplies the front cover sheet Sh from the sheet carry-in route 61 to the front-cover binding position F. This front cover sheet transportation route 64 includes a resist correction means 101. The shown resist correction means 101 is composed of: a stopper nail 102 for stopping and aligning sheet rear ends; a switch back roller 103 for switching back a sheet to this stopper nail 102; and a aligning member 104 for moving and aligning the sheet supported by the stopper nail 102 to a side reference position. The above front cover sheet transportation route 64 is connected with the paper ejection route 65 for transporting the sheet from the front-cover binding position F to a subsequent finisher apparatus C. The reason is that a printed sheet sent to the sheet carry-in route 61 can be transported to the finisher apparatus C without being subjected to a binding process.

The image formation system having the structure as described above is controlled in the manner as described below. First, the respective routes as described above include sensors for detecting sheets (sheet bundle). The control will be described for the binding apparatus B with reference to FIG. 2. The sheet carry-in route 61 includes an inlet sensor S1 provided at the shown position. The to-be-bound sheets transportation route 62 includes sheet sensors S2 and S3 and a paper ejection sensor S4 that detect the passage of a sheet, respectively. The placement tray 71 includes a tray sensor S5 and a tray position sensor S6 for detecting the existence or nonexistence of a sheet. The movable grip member 75*b* includes a grip sensor S7 for the existence or nonexistence of a sheet bundle. The tray position sensor S6 detects whether the placement tray 71 is positioned at the home position as the sheet accumulation position or not.

The glue container 81 of the adhesive application means 80 includes a glue container HP sensor S8 at the home position and sheet sensors S9 and S10 at the position of the bent roll 98 as shown in the drawing. The position of the bundle carrying-out means 69 has a sheet sensor S11 and the storage stacker 100 has a full sensor S12. The front cover sheet transportation route 64 includes sheet sensors S13 and S14 while the paper ejection route 65 includes sheet sensors S15 and S16. These sensors detect tip ends or rear ends of sheets passing the respective routes to perform a subsequent sheet feeding control simultaneous with the monitoring of the conditions of the sheets in the routes.

The respective routes include, in order to remove sheets (bundle) left in the apparatus due to paper jam or the like from the routes, covers having doors that can be opened or closed in the above-described casing 60 provided in the manner as described below. Specifically, the sheet carry-in route 61 includes an inlet cover 60*a*, the paper ejection route 65 includes a catch tray cover 60*b*, and the placement tray 71 includes, at the upper part thereof, an upper cover 60*c*, respectively, for the purpose of removing sheets (bundle) when an abnormality (e.g., paper jam) is caused. Similarly, in order to open the front cover sheet transportation route 64, door-like front covers 60*d* and 60*e* are provided at the front side of the apparatus (top side of FIG. 2) and the storage stacker 100 includes a door-like cover 60*f* for pulling the sheets (bundle) to the front side of the apparatus. These hinged covers 60*a* to 60*f* disposed in the casing 60 are provided in an ordinary configuration with safety switches that cut off power to the apparatus if they detect that the covers are open.

In the above-described configuration, the present invention is characterized in that, when power to the apparatus is cut off, sheets or a sheet bundle left remaining in the apparatus are conveyed outside the apparatus in the manner described below when the apparatus is restarted. For this purpose, a control means (the configuration of which will be described later)—which executes bookbinding processes sequentially on the sheet bundle Sp from the above-described sheet bundling/stacking means 70 in the order adhesive application, front-cover bind-on, and sheet-bundle exiting conveyance—carries out control functions in the following manner.

First Restart Operation

The above control means provides a control by which the sheet-position recognition means 135 determines, when a power source or another apparatus is shut down, the position of the sheet bundle Sp left in the above binding process path 63 so that the sheet bundle Sp is differently carried out, depending on the position at which the sheet bundle Sp is left, by the above bundle carrying-out means 69 when the apparatus is restarted. Specifically, depending on the position at which the sheet bundle Sp is left in the binding process path 63, the sheet bundle Sp is differently removed so that the sheet bundle Sp is removed by an operator or the sheet bundle Sp is automatically carried out to an external device of the apparatus (e.g., storage stacker 100), respectively. Furthermore, different binding processes are used so that a binding process (casing-in binding) is used when the apparatus correctly operates or a binding process (back glue binding) is used when the apparatus is restarted after the apparatus is interrupted.

Second Restart Operation

The above control means provides a control by which, when the remaining sheet bundle is positioned at the adhesive-application position or at the upstream side thereof, this remaining sheet bundle is coated with adhesive by the adhesive application means 80 to subsequently use the bundle carrying-out means 69 to carry out the storage stacker 100 without using the front-cover binding means 95 to bind the sheet bundle with the front cover sheet Sh (back glue binding). In this case, an amount of adhesive application can be reduced when compared with the above-described case where the gap Ga (see FIGS. 6(*a*) and 6(*b*)) between the coating roller 82 and the sheet bundle Sp is adjusted and a binding process is performed without discontinuing the apparatus (in a normal operation).

Third Restart Operation

The above control means provides a control by which, when the remaining sheet bundle is positioned at the downstream side of the front-cover binding position F, this remaining sheet bundle is carried by the bundle carrying-out means 69 to the storage stacker 100.

Figure 8:
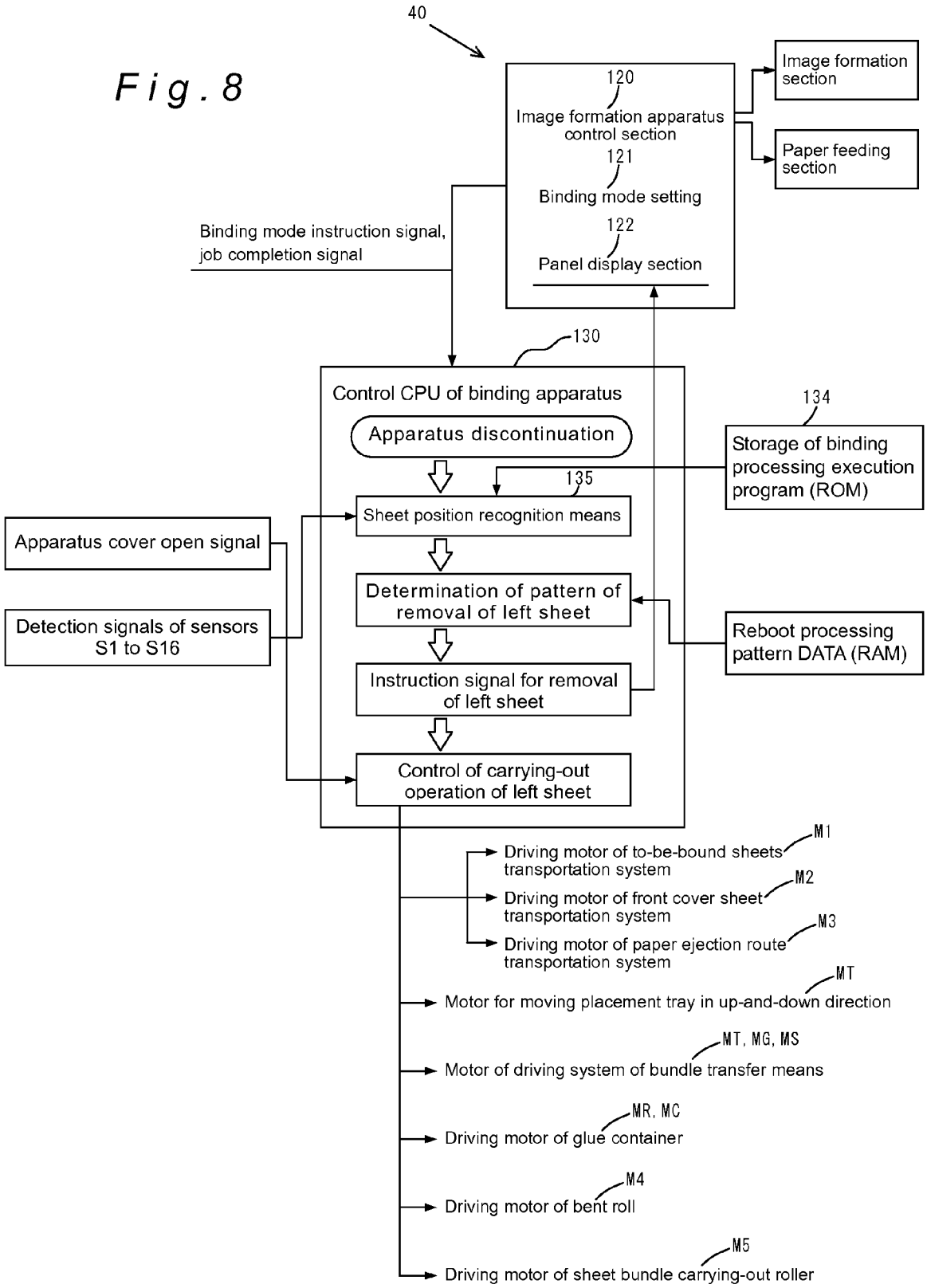
FIG. 8 is a block diagram illustrating the structure of a control means (control CPU) in the apparatus of FIG. 2.
Figure 9:
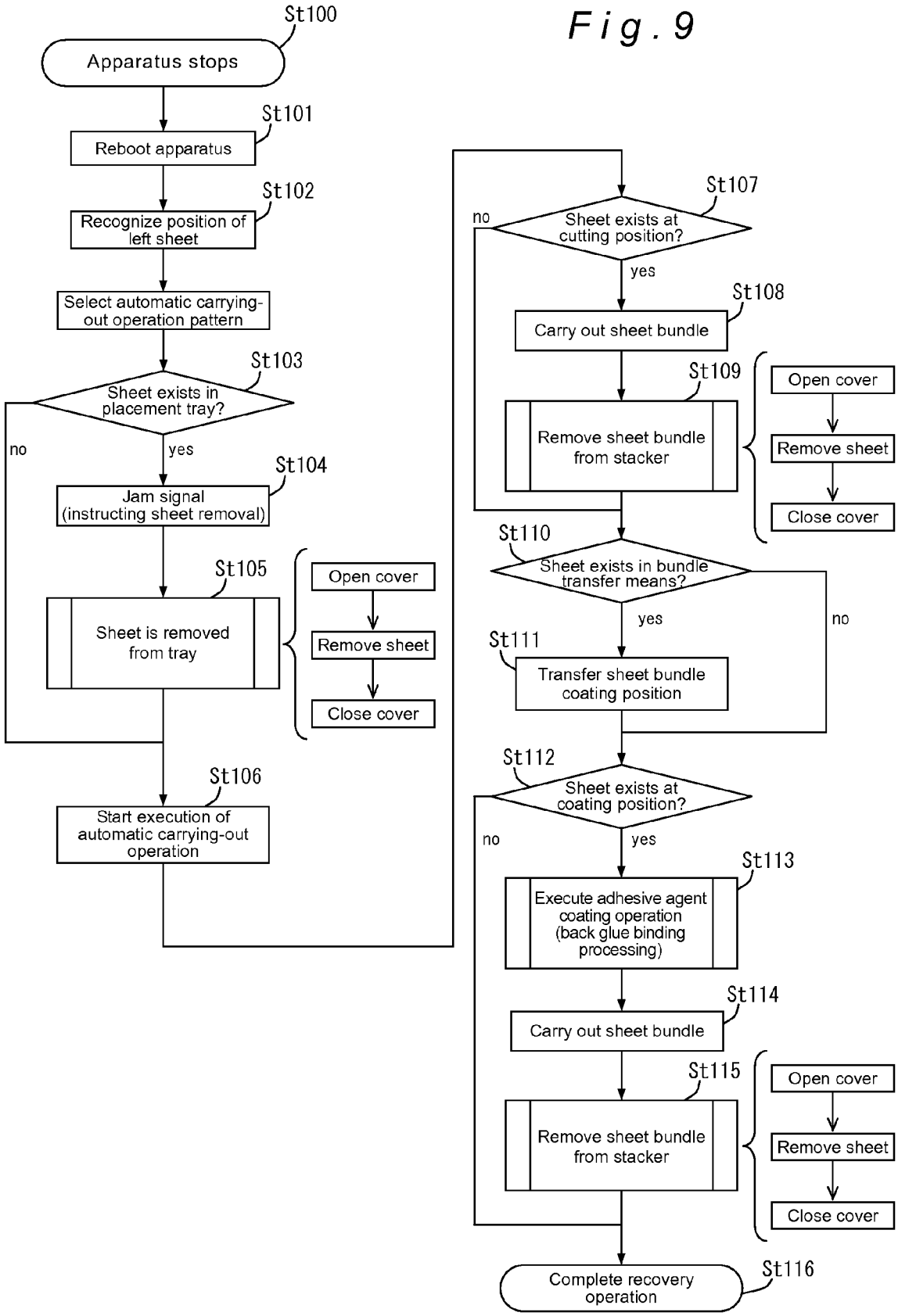
FIG. 9 is a flowchart illustrating a control procedure of the control means (control CPU) of FIG. 8.

The respective operations will be described with reference to FIG. 8 and FIG. 9. FIG. 8 is a block diagram illustrating the control configuration in the system of FIG. 1. FIG. 9 is a flowchart of an execution program in a binding operation when the apparatus is interrupted. First, in the system as shown in FIG. 1 in which the image formation apparatus A is connected to the binding apparatus B, the image formation apparatus A has a control section 40 that includes a control panel 122 and a mode selection means 121 for example. The image formation apparatus A has a control CPU 120 that inputs, through the control panel 122, a selected processing of "print processing mode" or "binding process mode." In the print processing mode, the binding apparatus B transports the printed sheet carried by the route switching means 66 to the sheet carry-in route 61 from the front cover sheet transportation route 64 and the paper ejection route 65 shown in FIG. 2 to the finisher apparatus C, thereby storing the sheet to a stacker provided in this finisher apparatus C. Thus, the printed sheet merely passes the binding apparatus B.

When the binding process mode is selected, the binding apparatus B guides the printed sheet from the sheet carry-in route 61 to the to-be-bound sheets transportation route 62. Then, the sheet passes the sheet bundling/stacking means 70, the adhesive application means 80, and the front-cover binding means 95 and the bound sheet is stored in the storage stacker 100. When the binding process mode is selected as described above, the control CPU 120 of the image formation apparatus A transmits to the binding apparatus B an instruction signal for a binding mode and size information of the printed sheet. The control CPU 120 of the image formation apparatus A also transfers, to the control CPU 130 of the binding apparatus B, number-of-prints information (e.g., a job completion signal showing when the final nth page is printed in a print processing of n pages).

The control CPU 130 of the binding apparatus B is composed of: a book binding control section; an inserter control section; and a cutting control section. The book binding control section is connected to: a driver circuit of a driving motor M1 of transportation rollers provided in the sheet carry-in route 61 and the to-be-bound sheets transportation route 62; a driver circuit of a driving motor M2 of a transportation roller provided in the front cover sheet transportation route 64; a driver circuit of a driving motor M3 of a transportation roller provided in the paper ejection route 65; and a driver circuit of a driving solenoid of the route switching means 66. Similarly, the book binding control section is also connected to: a driver circuit of the tray-up-and-down motor MT of the placement tray 71; a driver circuit of the unit rotation motor MU of the grip transportation means; a driver circuit of the grip motor MG; and a driver circuit of the shift motor MS for transporting sheet sheaves to the adhesive-application position.

The control CPU 130 is connected to: a driver circuit of the roller rotation motor MR for rotating the coating roller 82 for coating adhesive; and a driver circuit of the carriage motor MC moving this coating roller 82 along the sheet bundle Sp. Similarly, the control CPU 130 is also connected to: a driver circuit of the driving motor M4 of the bent roll 98 of the front-cover binding means 95 and a driver circuit of the driving motor M5 of the bundle carrying-out roller 69. The above-described sensors S1 to S16 provided in the respective transportation routes are also connected so as to transmit the detection signal to the control CPU 130. Then, the control CPU 130 calls an execution program of a binding operation from the ROM 134 to execute the operation shown in FIG. 9.

With reference to FIG. 9, the control operation of the above control CPU 130 will be described. An abnormal stop of the apparatus is caused due to a certain cause (St100). This apparatus discontinuation is caused when a power failure is caused, when a switch of the power source of the apparatus is turned OFF, or when a safety switch is operated when a cover of the casing 60 is opened, or when the power source of the apparatus is shut down when an error (e.g., paper jam) is caused in the apparatus for example. Next, when the above cause is eliminated and the power source of the apparatus is turned ON, the apparatus is restarted (St101). Then, the control CPU 130 detects the position of the left sheet based on status signals of the respective sensors S1 to S16 (St102) to select a predetermined "resume operation pattern." This resume operation pattern is set in pattern 1 to pattern 7 (which will be described later).

Then, the control CPU 130 determines whether the placement tray 71 includes the sheet bundle Sp or not (St103). When the placement tray 71 includes the sheet bundle Sp, this applies to the resume operation pattern 1 (which will be described later) and the control CPU 130 transmits a "jam signal" to the image formation apparatus A (St104) to prompt an operator to remove the sheet in the tray (St105). After this removal of the sheet bundle Sp, an operation for automatically carrying out the left sheet is started based on the resume operation pattern (St106). When the sheet bundle Sp is positioned at the cutting position G for example (St107), the control CPU 130 drives the bundle carrying-out means 69 (St108) to carry the sheet bundle Sp to the storage stacker 100. Then, the control CPU 130 issues an "overflow signal" to prompt an operator to remove the sheet bundle (St109). Then, the control CPU 130 determines whether the sheet bundle transportation means 75 includes the sheet bundle Sp or not (St110) to execute operations of patterns 3 to 7 (which will be described later) (St111 to St114). When the resume operation as described above is completed, the control CPU 130 issues a "recovery operation completion signal" to the image formation apparatus A (St116). Thereafter, a normal binding process operation is continued.

Figure 10:
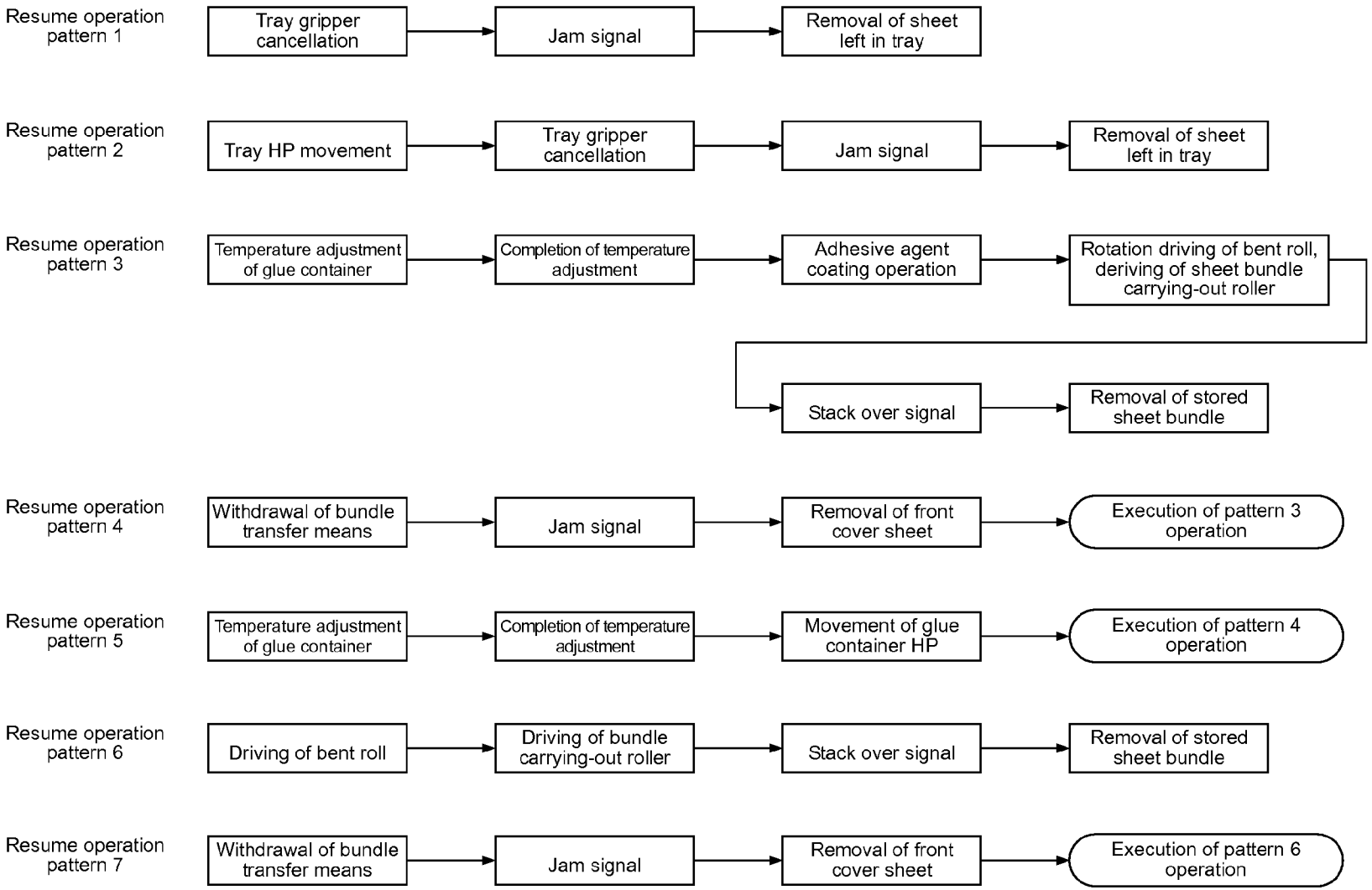
FIG. 10 illustrates an operation pattern in the flowchart of FIG. 9 when the apparatus is resumed.

Next, the above-described resume operation pattern will be described with reference to FIG. 10.

Resume Operation Pattern

When the placement tray 71 includes the sheet bundle Sp at the apparatus discontinuation and this tray is at the sheet accumulation position (position shown by solid line of FIG. 2), an operation for canceling the above-described tray gripper 77 is performed. Thus, the sheet in the placement tray 71 can be removed. Specifically, the sheet-position recognition means 135 of the control CPU 130 uses the tray sensor S5 for detecting the existence or nonexistence of the sheet in the placement tray 71 and the tray position sensor S6 for detecting a position to which the placement tray 71 is moved in an up-and-down direction to recognize that the left sheet exists in the placement tray 71 (S5=1) and the placement tray 71 is at the sheet accumulation position (S6=1). Based on this recognition, the control CPU 130 drives the tray gripper motor MTG to move the tray gripper 77 to a canceling position. Next, the control CPU 130 issues a jam signal to the image formation apparatus A to display "please remove sheet in tray" on the control panel 122 to prompt the left sheet in the placement tray 71 to be removed.

Resume Operation Pattern 2

When the placement tray 71 includes the sheet bundle Sp at the apparatus discontinuation and this tray is not at the sheet accumulation position (position shown by solid line of FIG. 2), the placement tray 71 is returned to the sheet accumulation position (home position) to subsequently perform an operation for canceling the tray gripper 77. When the placement tray 71 is at the delivery position (position shown by chain line of FIG. 2) or in the middle of the movement, the placement tray 71 is moved backward (direction shown in FIG. 2) and is returned to the home position to cancel the tray gripper 77. Specifically, when S5=1 and S6=0 are established, the control CPU 130 reversely rotates the tray-up-and-down motor MT (direction along which the tray is raised) to return the placement tray 71 to the home position. Next, when S7=1 is established, the control CPU 130 drives the tray gripper motor MTG to move the tray gripper 77 to the canceling position. Next, the control CPU 130 issues a jam signal to the image formation apparatus A to cause the control panel 122 to display "please remove sheet in tray," thereby prompting the sheet left in the placement tray 71 to be removed.

Resume Operation Pattern 3

When the sheet bundle Sp at the apparatus discontinuation is at the adhesive-application position E and is not yet subjected to glue coating and when the front cover sheet transportation route 64 includes the front cover sheet Sh, the back glue binding process operation is performed. Specifically, this status is determined by the sheet-position recognition means 135 based on the grip sensor S7 of the sheave transport means 75, the sheet sensors S13 and S14 of the front cover sheet transportation route 64, and the glue container HP sensor S8. When S7=1, S13=0 as well as S14=0 and S8=1 are established for example, the sheet bundle Sp is held by the sheave transport means 75 and a status prior to the glue coating is determined. Thus, the control CPU 130 drives the rotation of the shift motor MS of the sheave transport means 75 to position the sheet bundle Sp at the adhesive-application position E.

Next, the control CPU 130 adjusts the temperature of the glue container 81 to subsequently perform a glue coating operation. In this glue coating operation, the above-described carriage motor MC reciprocates the glue container 81 while causing the roller rotation motor MR to rotate the coating roller 82. After this coating operation, the control CPU 130 restarts the shift motor MS of the sheave transport means 75 to send the sheet bundle Sp to the bent roll 98 of the binding process path 63. Then, the sheet bundle Sp nipped by this bent roll 98 is transported to the downstream and is carried by the bundle carrying-out means 69 to the storage stacker 100. The sheet bundle Sp held by the sheave transport means 75 by this operation is transported to the adhesive-application position E and the sheet bundle Sp is coated with adhesive. Then, the sheet bundle Sp being subjected to this back glue binding is stored in the storage stacker 100. Next, the control CPU 130 issues a "stack over" signal for example to the image formation apparatus A to prompt the operator to remove the sheet bundle Sp.

Resume Operation Pattern 4

When the sheet bundle Sp at the apparatus discontinuation is not yet subjected to glue coating at the adhesive-application position and when the front cover sheet transportation route 64 includes the front cover sheet Sh, the back glue binding process operation is performed. Specifically, this status is determined by the sheet-position recognition means 135 based on the grip sensor S7 of the sheave transport means 75, the sheet sensors S13 and S14 of the front cover sheet transportation route 64, and the glue container HP sensor S8. When S7=1 and S13=1 or S14=1 and S8=1 are established for example, the control CPU 130 issues a jam signal to the image formation apparatus A to prompt the front cover sheet to be removed. Next, the control CPU 130 causes the sheet sensors S13 and S14 to check that the front cover sheet Sh is removed from the front cover sheet transportation route 64 to perform the same processing operation as that of the above resume operation pattern 3.

Resume Operation Pattern 5

When the sheet bundle Sp being glued exists at the adhesive-application position E at the apparatus discontinuation and when the front cover sheet transportation route 64 includes the front cover sheet Sh, the following back glue binding process is performed. Specifically, this status is determined by the sheet-position recognition means 135 based on the grip sensor S7 of the sheave transport means 75, the sheet sensors S13 and S14 of the front cover sheet transportation route 64, and the glue container HP sensor S8. When S7=and S13=1 or S14=1 and S8=0 are established for example, the control CPU 130 firstly adjusts the temperature of the adhesive glue container 81. The reason is that the adhesive glue container 81 may be away from the home position HP and may have a contact with the sheet bundle Sp and thus adhesive may be solidified during the apparatus discontinue. Thus, the control CPU 130 heats the adhesive glue container 81 for example to melt the adhesive. After this temperature adjustment of the adhesive glue container 81, the control CPU 130 moves the adhesive glue container 81 to the home position HP. In this status, the glue container HP sensor S8=1 is established, providing the same condition as that of the resume operation pattern 4. Thus, the same operation as that of the above pattern 4 is performed.

Resume Operation Pattern 6

When the sheet bundle Sp at the apparatus discontinuation is left at the downstream side of the adhesive-application position E, the control CPU 130 does not perform a subsequent processing and carries the sheet bundle Sp to the storage stacker 100. Specifically, this status is determined by the sheet-position recognition means 135 based on the sheet sensors S9, S10, and S11 and the control CPU 130 drives, when any of the sensors has "1" showing that the sensor includes a paper, the bent roll 98 and the bundle carrying-out means 69 to carry the remaining sheet bundle to the storage stacker 100. Thereafter, the control CPU 130 issues a "stack over" signal for example to the image formation apparatus A to prompt an operator to remove the sheet.

Resume Operation Pattern 7

When the remaining sheet bundle prior to coating or in the middle of coating at the apparatus discontinuation is at the adhesive-application position E and when the remaining sheet bundle exists at the downstream side of the adhesive-application position E and the front cover sheet transportation route 64 includes the front cover sheet Sh, the control CPU 130 sequentially performs the following operation. Specifically, when any of the sheet sensors S9, S10, and S11 has "1," the control CPU 130 moves the sheave transport means 75 to the home position upwardly withdrawn from the front-cover binding position F. Next, a jam signal is issued to the image formation apparatus A to prompt the operator to remove the front cover sheet Sh. When the removal of this front cover sheet Sh is checked by the control CPU 130 by the sheet sensors S13 and S14, the control CPU 130 performs an operation of the above pattern 6. This operation carries the remaining sheet bundle at the downstream side of the adhesive-application position E to the storage stacker 100 to allow the operator to remove the sheet bundle. Thereafter, the control CPU 130 performs the operation of the above pattern 4 or pattern 5. This operation subjects the remaining sheet bundle positioned at the upstream side of the adhesive-application position E to a back glue processing to subsequently carry sheet to the storage stacker 100 to cause the sheet to be removed by the operator. This application claims priority rights from Japanese Pat. App. No. 2006-64885, which is herein incorporated by reference.

What is claimed is:

1. A bookbinding apparatus, comprising:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted.

2. The bookbinding apparatus according to claim 1, wherein said control means is configured to execute a control function whereby, when the sheet-position recognition means recognizes that a sheaf left in the binding process path is positioned at the adhesive-application position or at the upstream side thereof, the remaining sheaf is coated with adhesive by the adhesive application means to carry out the sheaf by the sheaf exiting-conveyance means to the storage stacker without being bound with a front cover sheet by the front-cover binding means.

3. The bookbinding apparatus according to claim 1, wherein:

said control means includes a casing-in binding mode for binding the sheaf coated with the adhesive by the adhesive-application position with a front cover sheet at the front-cover binding position to carry out the sheaf to the storage stacker, and a back glue binding mode for carrying the sheaf to the storage stacker without being bound with a front cover sheet at the front-cover binding position; and said control means subjects the sheaf to the casing-in binding mode when the apparatus normally operates and subjects the sheaf to the back glue binding mode if a sheaf left in the binding process path exists at the adhesive-application position or at the upstream thereof when the apparatus is restarted after discontinuation of the apparatus.

4. A bookbinding apparatus, comprising:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted, and to issue an instruction signal for removing the sheaf from the sheet bundling/stacking means when the remaining sheaf is positioned at the sheet bundling/stacking means, and to execute a control function whereby, when the remaining sheaf is supported by the sheaf transport means, this remaining sheaf is coated with adhesive by the adhesive application means to carry the sheaf, without being bound with a front cover sheet by the front-cover binding means, by the sheaf exiting-conveyance means to the storage stacker.

5. A bookbinding apparatus, comprising:

a bundling/stacking means for bundling sequentially supplied sheets into sheaves a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted, and to execute a control function whereby:

when the remaining sheaf is positioned at the sheet bundling/stacking means, an instruction signal for removing this remaining sheaf is issued;

when the remaining sheaf is positioned at the upstream side of the adhesive-application position while being supported by the sheaf transport means, this remaining sheaf is coated with adhesive by the adhesive application means to carry the sheaf by the sheaf exiting-conveyance means to the storage stacker; and when the remaining sheaf is positioned at the downstream of the front-cover binding position, this remaining sheaf is carried out by the sheave exiting-conveyance means to the storage stacker.

6. A bookbinding apparatus, comprising:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive, said adhesive application means being structured to be able to coat the sheaf with adhesive in an adjustable amount;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted, to execute a control function whereby, when the sheet-position recognition means recognizes that a sheaf left in the binding process path is positioned at the adhesive-application position or at the upstream side thereof, the remaining sheaf is coated with adhesive by the adhesive application means to carry out the sheaf by the sheaf exiting-conveyance means to the storage stacker without being bound with a front cover sheet by the front-cover binding means, and to execute a control function whereby, when the adhesive application means coats the remaining sheaf with adhesive when the apparatus is restarted, the adhesive is coated in a smaller amount than that in a case where the sheaf is subjected to a binding process without discontinuing the apparatus.

7. The bookbinding apparatus according to claim 4, wherein said control means is configured to execute a control function whereby, when the remaining sheaf is included both in the sheet bundling/stacking means and in the sheaf transport means when the apparatus is restarted, the sheaf is removed from the sheet bundling/stacking means to subsequently start the adhesive application means.

8. The bookbinding apparatus according to claim 5, wherein said control means is configured to execute a control function whereby, when the remaining sheaf is included both in the sheet bundling/stacking means and in the sheaf transport means when the apparatus is restarted, the sheaf is removed from the sheet bundling/stacking means to subsequently start the adhesive application means.

9. The bookbinding apparatus according to claim 5, wherein said control means is configured to execute a control function whereby, when the remaining sheaf is included both in the sheaf transport means and in the sheaf exiting-conveyance means when the apparatus is restarted, the sheaf is carried out by the sheaf exiting-conveyance means to subsequently start the adhesive application means.

10. An image formation system, comprising:

an image formation apparatus for sequentially forming images on a printed sheet; and a bookbinding apparatus for bundling and bookbinding printed sheets from the image formation apparatus, said binding apparatus including:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted.

11. The image formation system according to claim 10, wherein said control means is configured to execute a control function whereby, when the sheet-position recognition means recognizes that the sheaf left in the binding process path is positioned at the adhesive-application position or at the upstream side thereof, this remaining sheaf is coated with adhesive by the adhesive application means to carry out the sheaf by the sheaf exiting-conveyance means to the storage stacker without being bound with a front cover sheet by the front-cover binding means.

12. The image formation system according to claim 10, wherein:

said control means includes a casing-in binding mode for binding the sheaf coated with the adhesive by the adhesive-application position with a front cover sheet at the front-cover binding position to carry out the sheaf to the storage stacker, and a back glue binding mode for carrying the sheaf to the storage stacker without being bound with a front cover sheet at the front-cover binding position; and said control means subjects the sheaf to the casing-in binding mode when the apparatus normally operates and subjects the sheaf to the back glue binding mode the sheaf left in the binding process path exists at the adhesive-application position or at the upstream thereof when the apparatus is restarted after discontinuation of the apparatus.

13. An image formation system, comprising:

an image formation apparatus for sequentially forming images on a printed Sheet; and a bookbinding apparatus for bundling and bookbinding printed sheets from the image formation apparatus, said binding apparatus including:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted, and to execute a control function whereby:

when the remaining sheaf is positioned at the sheet bundling/stacking means, an instruction signal for removing this remaining sheaf is issued;

when the remaining sheaf is positioned at the upstream side of the adhesive-application position while being supported by the sheaf transport means, this remaining sheaf is coated with adhesive by the adhesive application means to carry the sheaf by the sheaf exiting-conveyance means to the storage stacker; and when the remaining sheaf is positioned at the downstream of the front-cover binding position, this remaining sheaf is carried out by the sheave exiting-conveyance means to the storage stacker.

14. An image formation system, comprising:

an image formation apparatus for sequentially forming images on a printed Sheet; and a bookbinding apparatus for bundling and bookbinding printed sheets from the image formation apparatus, said binding apparatus including:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive, said adhesive application means being structured to be able to coat the sheave with adhesive in an adjustable amount;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted, to execute a control function whereby, when the sheet-position recognition means recognizes that a sheaf left in the binding process path is positioned at the adhesive-application position or at the upstream side thereof, the remaining sheaf is coated with adhesive by the adhesive application means to carry out the sheaf by the sheaf exiting-conveyance means to the storage stacker without being bound with a front cover sheet by the front-cover binding means, and to execute a control function whereby, when the adhesive application means coats the remaining sheaf with adhesive when the apparatus is restarted, the adhesive is coated in a smaller amount than that in a case where the sheaf is subjected to a binding process without discontinuing the apparatus.

15. A bookbinding apparatus, comprising:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein said control means is configured so as:

to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted; and to execute a control function whereby, when the sheet-position recognition means recognizes that a sheaf left in the binding process path is positioned at the adhesive-application position or at the upstream side thereof, the remaining sheaf is coated with adhesive by the adhesive application means to carry out the sheaf by the sheaf exiting-conveyance means to the storage stacker without being bound with a front cover sheet by the front-cover binding means.

16. The image formation system according to claim 13 wherein said control means is configured to execute a control function whereby, when the remaining sheaf is included both in the sheet bundling/stacking means and in the sheaf transport means when the apparatus is restarted, the sheaf is removed from the sheet bundling/stacking means to subsequently start the adhesive application means.

17. The image formation system according to claim 13 wherein said control means is configured to execute a control function whereby, when the remaining sheaf is included both in the sheaf transport means and in the sheaf exiting-conveyance means when the apparatus is restarted, the sheaf is carried out by the sheaf exiting-conveyance means to subsequently start the adhesive application means.

18. An image formation system, comprising:

an image formation apparatus for sequentially forming images on a printed sheet; and a bookbinding apparatus for bundling and bookbinding printed sheets from the image formation apparatus, said binding apparatus including:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein:

said control means is configured so as to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted, and to issue an instruction signal for removing the sheaf from the sheet bundling/stacking means when the remaining sheaf is positioned at the sheet bundling/stacking means, and to execute a control function whereby, when the remaining sheaf is supported by the sheaf transport means, this remaining sheaf is coated with adhesive by the adhesive application means to carry the sheaf, without being bound with a front cover sheet by the front-cover binding means, by the sheaf exiting-conveyance means to the storage stacker.

19. The image formation system according to claim 18 wherein said control means is configured to execute a control function whereby, when the remaining sheaf is included both in the sheet bundling/stacking means and in the sheaf transport means when the apparatus is restarted, the sheaf is removed from the sheet bundling/stacking means to subsequently start the adhesive application means.

20. A bookbinding apparatus, comprising:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance, said control means including a casing-in binding mode for binding the sheaf coated with the adhesive by the adhesive-application position with a front cover sheet at the front-cover binding position to carry out the sheaf to the storage stacker, and a back glue binding mode for carrying the sheaf to the storage stacker without being bound with a front cover sheet at the front-cover binding position; wherein said control means is configured so as:

to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted; and to subject the sheaf to the casing-in binding mode when the apparatus normally operates, and to subject the sheaf to the back glue binding mode if a sheaf left in the binding process path exists at the adhesive-application position or at the upstream thereof when the apparatus is restarted after discontinuation of the apparatus.

21. An image formation system, comprising:

an image formation apparatus for sequentially forming images on a printed sheet; and a bookbinding apparatus for bundling and bookbinding printed sheets from the image formation apparatus, said binding apparatus including:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance; wherein said control means is configured so as:

to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted; and to execute a control function whereby, when the sheet-position recognition means recognizes that a sheaf left in the binding process path is positioned at the adhesive-application position or at the upstream side thereof, the remaining sheaf is coated with adhesive by the adhesive application means to carry out the sheaf by the sheaf exiting-conveyance means to the storage stacker without being bound with a front cover sheet by the front-cover binding means.

22. An image formation system, comprising: an image formation apparatus for sequentially forming images on a printed sheet; and a bookbinding apparatus for bundling and bookbinding printed sheets from the image formation apparatus, said binding apparatus including:

a bundling/stacking means for bundling sequentially supplied sheets into sheaves;

a binding process path in which binding processes are carried out on sheaves from the sheet bundling/stacking means, and in which an adhesive-application position and a front-cover binding position are sequentially disposed;

a sheaf transport means for transporting sheaves from the sheet bundling/stacking means into the binding process path;

an adhesive application means, provided at the adhesive-application position, for coating an edge of a sheaf with adhesive;

a front-cover binding means, provided in the front-cover binding position, for binding a sheaf together with a front cover;

a sheaf exiting-conveyance means for conveying sheaves from the front-cover binding means to a storage stacker;

a sheet-position recognition means for detecting/monitoring position of a sheaf in the binding process path; and a control means for executing binding processes sequentially on sheaves from said sheet bundling/stacking means in the order adhesive application, front-cover bind-on, and sheet-bundle exiting conveyance, said control means including a casing-in binding mode for binding the sheaf coated with the adhesive by the adhesive-application position with a front cover sheet at the front-cover binding position to carry out the sheaf to the storage stacker, and a back glue binding mode for carrying the sheaf to the storage stacker without being bound with a front cover sheet at the front-cover binding position; wherein said control means is configured so as:

to cause, if power to the bookbinding apparatus is cut off or the apparatus is otherwise operationally interrupted, the sheet-position recognition means to determine the position of any sheaf left behind in the binding process path and to alter, depending on the position in which the sheaf is left behind, the manner in which the sheaf is processed when the bookbinding apparatus is restarted; and to subject the sheaf to the casing-in binding mode when the apparatus normally operates, and to subject the sheaf to the back glue binding mode if a sheaf left in the binding process path exists at the adhesive-application position or at the upstream thereof when the apparatus is restarted after discontinuation of the apparatus.

* * * * *